US009593693B2

(12) United States Patent
Howell et al.

(10) Patent No.: US 9,593,693 B2
(45) Date of Patent: Mar. 14, 2017

(54) SEAL SECTION WITH PARALLEL BAG SECTIONS

(75) Inventors: Alan Howell, Oklahoma City, OK (US); Chengbao Wang, Oklahoma City, OK (US); Brian Reeves, Edmond, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 868 days.

(21) Appl. No.: 13/424,191

(22) Filed: Mar. 19, 2012

(65) Prior Publication Data

US 2013/0240199 A1 Sep. 19, 2013

(51) Int. Cl.
*F04D 29/08* (2006.01)
*E21B 43/12* (2006.01)

(52) U.S. Cl.
CPC ..... *F04D 29/086* (2013.01); *E21B 43/128* (2013.01)

(58) Field of Classification Search
CPC ..... F04D 29/04; F04D 29/08; F04D 29/086; F04D 29/106; F04D 13/08; E21B 43/128
USPC ..... 417/365, 423.3, 423.11–423.13, 424.2, 417/41; 277/336, 337, 423, 429–430; 166/66.4, 68, 105.1, 105.3
See application file for complete search history.

(56) References Cited

U.S. PATENT DOCUMENTS 4,421,999 A 12/1983 Beavers et al.
4,667,737 A * 5/1987 Shaw ..... F16J 15/004 166/104
4,684,331 A 8/1987 LaGrange et al.
4,992,689 A 2/1991 Bookout
5,367,214 A 11/1994 Turner, Jr.
5,404,061 A * 4/1995 Parmeter ..... 310/87
5,622,222 A * 4/1997 Wilson ..... E21B 41/02 166/105.4
5,796,197 A 8/1998 Bookout
6,242,829 B1 6/2001 Scarsdale
6,307,290 B1 10/2001 Scarsdale
6,602,059 B1 8/2003 Howell et al.
6,666,664 B2 12/2003 Gross
6,688,860 B2 2/2004 Du et al.
6,981,853 B2 1/2006 Du et al.
7,066,248 B2 6/2006 Howell
(Continued)

FOREIGN PATENT DOCUMENTS

WO WO2006027120 3/2006

*Primary Examiner* — Devon Kramer
*Assistant Examiner* — Kenneth J Hansen
(74) *Attorney, Agent, or Firm* — Crowe & Dunlevy, P.C.

(57) ABSTRACT

A downhole pumping system includes a motor, a pump driven by the motor and a seal section positioned between the pump and the motor. The seal section preferably includes a first seal bag assembly, a second seal bag assembly and an interconnect module connected between the first seal bag assembly and the second seal bag assembly. The interconnect module includes a plenum, at least one fluid exchange passage connected to the plenum, and a shaft seal assembly. The shaft seal assembly is configured to divert fluid from the plenum into the at least one fluid exchange passage. In another aspect, a first group of interconnect modules within the seal section each includes a shaft seal assembly oriented in a first direction and a second group of the interconnect modules each includes a shaft seal assembly oriented in a second direction to selectively apply an axial force on the shaft.

8 Claims, 4 Drawing Sheets

(56) References Cited

U.S. PATENT DOCUMENTS

| | | | | |
|---|---|---|---|---|
| 7,182,584 | B2 | 2/2007 | Du et al. | |
| 7,217,107 | B2 | 5/2007 | Du et al. | |
| 7,344,356 | B1 * | 3/2008 | Howell et al. | 415/174.2 |
| 7,370,691 | B2 | 5/2008 | Klingler et al. | |
| 7,400,074 | B2 | 7/2008 | Zhuang et al. | |
| 7,530,391 | B2 | 5/2009 | Hall et al. | |
| 7,654,315 | B2 | 2/2010 | Du et al. | |
| 7,665,975 | B2 | 2/2010 | Parmeter et al. | |
| 7,741,744 | B2 | 6/2010 | Watson et al. | |
| 7,775,779 | B2 | 8/2010 | Sheth et al. | |
| 7,806,670 | B2 | 10/2010 | Du et al. | |
| 7,824,161 | B2 | 11/2010 | Tandon | |
| 2003/0156947 | A1 * | 8/2003 | Gross | 417/53 |
| 2004/0146415 | A1 * | 7/2004 | Merrill et al. | 417/414 |
| 2005/0087343 | A1 * | 4/2005 | Du et al. | 166/369 |
| 2006/0196655 | A1 * | 9/2006 | Wang | 166/105.3 |
| 2009/0035159 | A1 | 2/2009 | Speer et al. | |
| 2009/0202371 | A1 | 8/2009 | Green | |
| 2012/0263610 | A1 | 10/2012 | Tetzlaff | |

* cited by examiner

SEAL SECTION WITH PARALLEL BAG SECTIONS

FIELD OF THE INVENTION

This invention relates generally to the field of submersible pumping systems, and more particularly, but not by way of limitation, to an improved seal section for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system must be engineered to withstand the inhospitable downhole environment, which includes wide ranges of temperature, pressure and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, absorbing axial thrust imparted by the pump, and accommodating the expansion and contraction of the dielectric motor lubricant as the motor moves through thermal cycles during operation and pressure equalization. Many seal sections employ seal bags to accommodate the volumetric changes and movement of fluid in the seal section. Seal bags can also be configured to provide a positive barrier between clean lubricant and contaminated wellbore fluid.

Modern seal sections may include two or more seal bags connected in parallel or series configurations. When seal bags are placed in series, the oil from one bag is kept separate from the oil in another bag by the use of a shaft seal between each section. In this way, seal bags connected in a series configuration function as redundant seals. If the first seal bag is compromised or avoided, the foreign fluid is prevented from going into the motor by the second seal bag.

In contrast, multiple seal bags connected in a parallel configuration do not provide a redundant layer of protection. Instead, seal bags connected in a parallel configuration are intended to simply increase the overall effective volume change capacity within the seal section. In prior art parallel seal bag configurations, there is typically no shaft seal placed between adjacent seal bags and fluid is encouraged to communicate concurrently between bag sections along the shaft. Although effective at increasing fluid exchange capacity, the use of directly connected parallel seal bags presents a concern if a contaminated fluid is allowed to quickly migrate through the parallel seal bags. There is, therefore, a need for an improved seal section that overcomes the deficiencies of the prior art while retaining the benefits of parallel seal bag sections. It is to this and other needs that the present invention is directed.

SUMMARY OF THE INVENTION

In a preferred embodiment, the present invention provides a downhole pumping system that includes a motor, a pump driven by the motor and a seal section positioned between the pump and the motor. The seal section preferably includes a first seal bag assembly, a second seal bag assembly and an interconnect module connected between the first seal bag assembly and the second seal bag assembly. The interconnect module includes a plenum, at least one fluid exchange passage connected to the plenum, and a shaft seal assembly. The shaft seal assembly is configured to divert fluid from the plenum into the at least one fluid exchange passage.

In another aspect, the plenum, the at least one fluid exchange passage and the shaft seal assembly cooperate to form a fluid labyrinth through the interconnect module. In a first group of interconnect modules within the seal section, the shaft seal assemblies are oriented in a first direction and within a second group of the interconnect modules the shaft seal assemblies are oriented in a second direction to apply an axial force to position the shaft in the operative position or to balance the axial force generated by the shaft seal assemblies in the first group of interconnect modules.

DETAILED DESCRIPTION OF THE PREFERRED EMBODIMENTS

Figure 1:
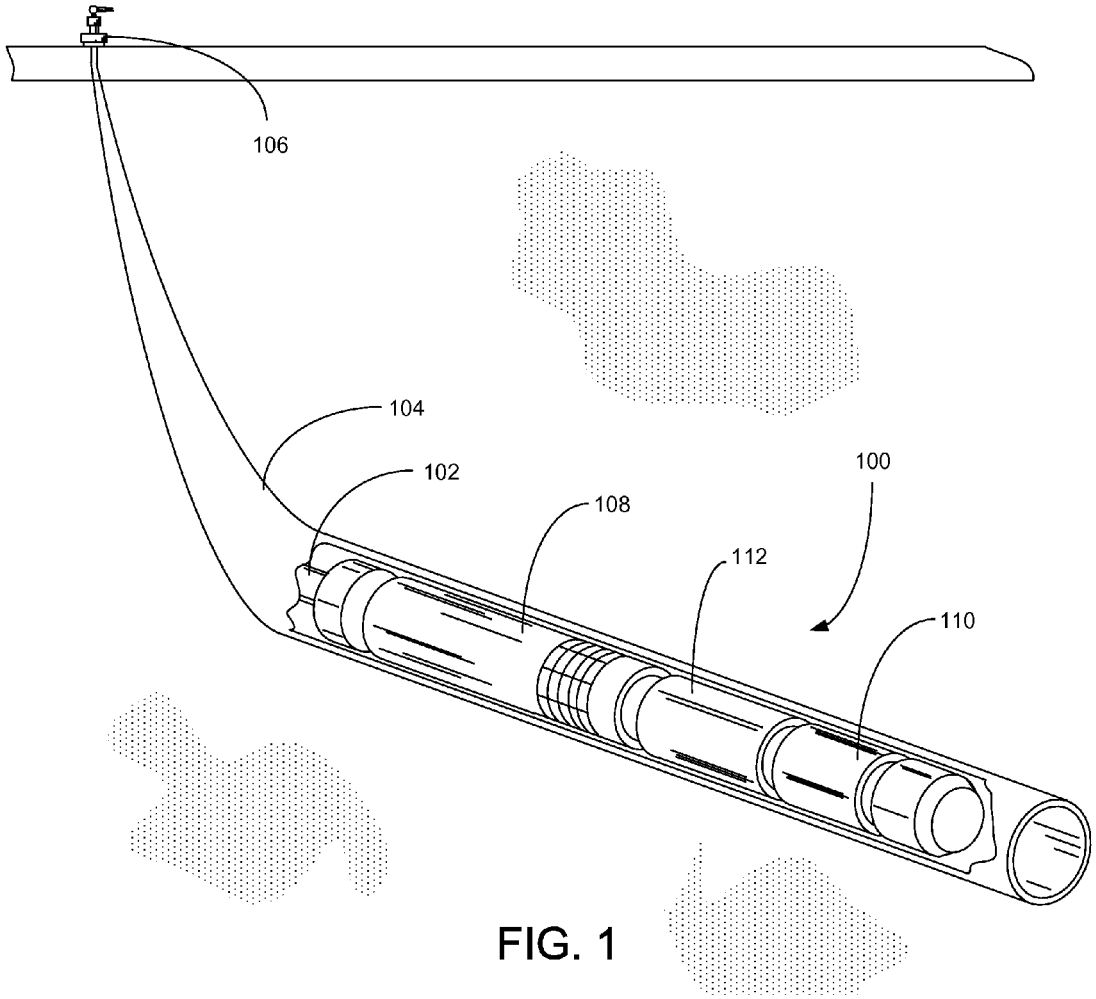
FIG. 1 is a front perspective view of a downhole pumping system in a non-vertical installation.

In accordance with a preferred embodiment of the present invention, FIG. 1 shows a front perspective view of a downhole pumping system 100 attached to production tubing 102. The downhole pumping system 100 and production tubing 102 are disposed in a wellbore 104, which is drilled for the production of a fluid such as water or petroleum. The downhole pumping system 100 is shown in a non-vertical well. This type of well is often referred to as a "horizontal" well. Although the downhole pumping system 100 is depicted in a horizontal well, it will be appreciated that the downhole pumping system 100 can also be used in vertical wells.

As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system 100 are primarily disclosed in a submersible application, some or all of these components can also be used in surface pumping operations.

The pumping system 100 preferably includes some combination of a pump assembly 108, a motor assembly 110 and a seal section 112. In a preferred embodiment, the motor assembly 110 is an electrical motor that receives its power from a surface-based supply. The motor assembly 110 converts the electrical energy into mechanical energy, which is transmitted to the pump assembly 108 by one or more shafts. The pump assembly 108 then transfers a portion of this mechanical energy to fluids within the wellbore, causing the wellbore fluids to move through the production tubing to the surface. In a particularly preferred embodiment, the pump assembly 108 is a turbomachine that uses one or more impellers and diffusers to convert mechanical energy into pressure head. In an alternative embodiment, the pump assembly 108 is a progressive cavity (PC) or positive displacement pump that moves wellbore fluids with one or more screws or pistons.

The seal section 112 shields the motor assembly 110 from mechanical thrust produced by the pump assembly 108. The seal section 112 is also preferably configured to prevent the introduction of contaminants from the wellbore 104 into the motor assembly 110. Although only one pump assembly 108, seal section 112 and motor assembly 110 are shown, it will be understood that the downhole pumping system 100 could include additional pumps assemblies 108, seals sections 112 or motor assemblies 110.

Figure 2:
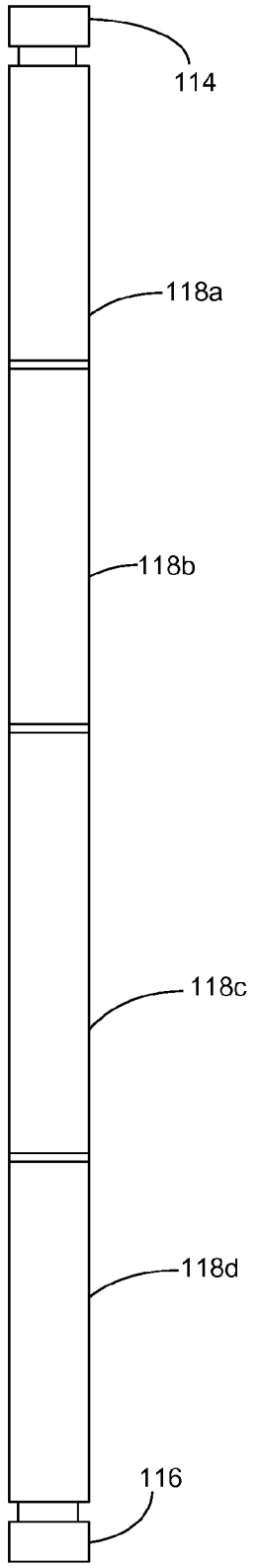
FIG. 2 is an elevational view of a seal section constructed in accordance with a presently preferred embodiment.

Referring now to FIG. 2, shown therein is an elevational view of the seal section 112. The seal section 112 includes a head 114, a base 116 and four bag sections 118*a*-118*d*. The head 114 is configured for connection to the pump assembly 108 and the base 116 is configured for connection to the motor assembly 110. Unless otherwise noted, each of the bag sections 118 includes the same components. It will be understood, however, that the seal section 112 may include bag sections 118 that include different components or components arranged in different configurations.

Figure 3:
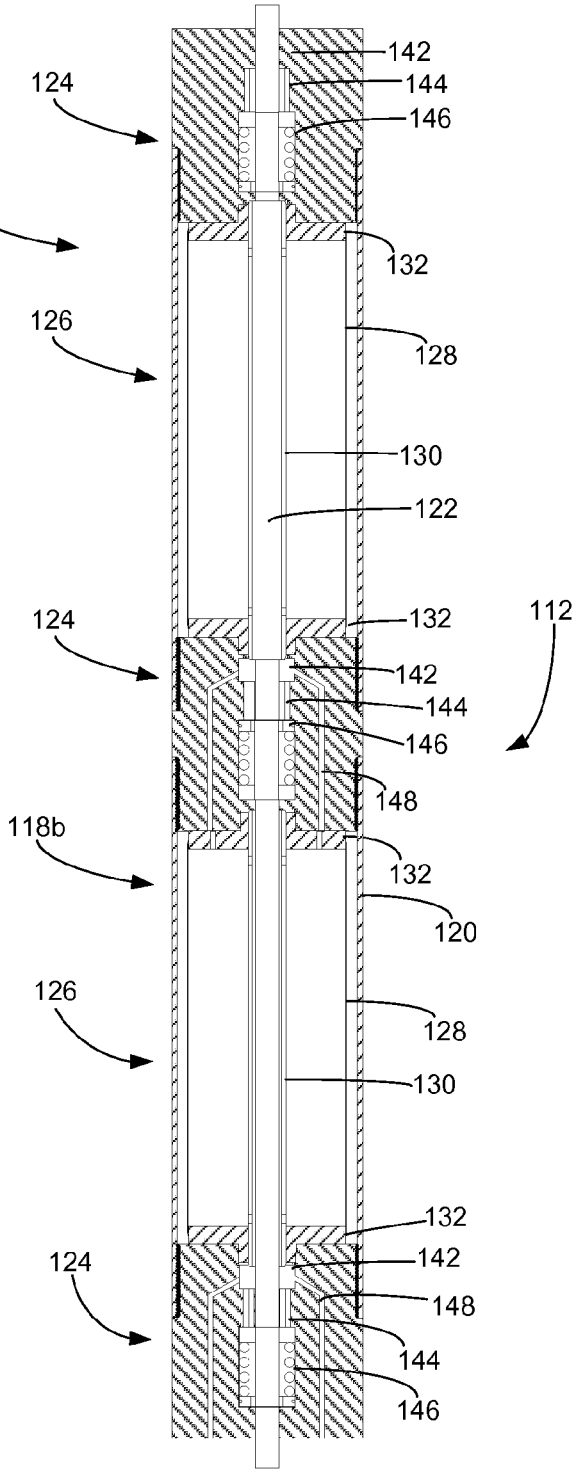
FIG. 3 is a cross-sectional view of a portion of the seal section of FIG. 2.

Continuing with FIG. 2, but referring now also to FIG. 3, shown therein is a cross-sectional view of two of the bag sections 118*a*, 118*b*. As depicted in FIG. 3, the seal section 112 includes a common housing 120 and a common shaft 122. The shaft 122 transfers mechanical energy from the motor assembly 110 to the pump assembly 108. Each bag section 118 within the seal section 112 includes an interconnect module 124 and a seal bag assembly 126. It will be understood that the housing 120 may be segmented, with separate sections joined by a threaded connection to the interconnect module 124. In turn, each seal bag assembly 126 includes a seal bag 128, bag support tube 130 and a seal bag retention mechanism 132. In a first preferred embodiment, the seal bag retention mechanism 132 includes a conventional flange and locking clamp arrangement.

Figure 4:
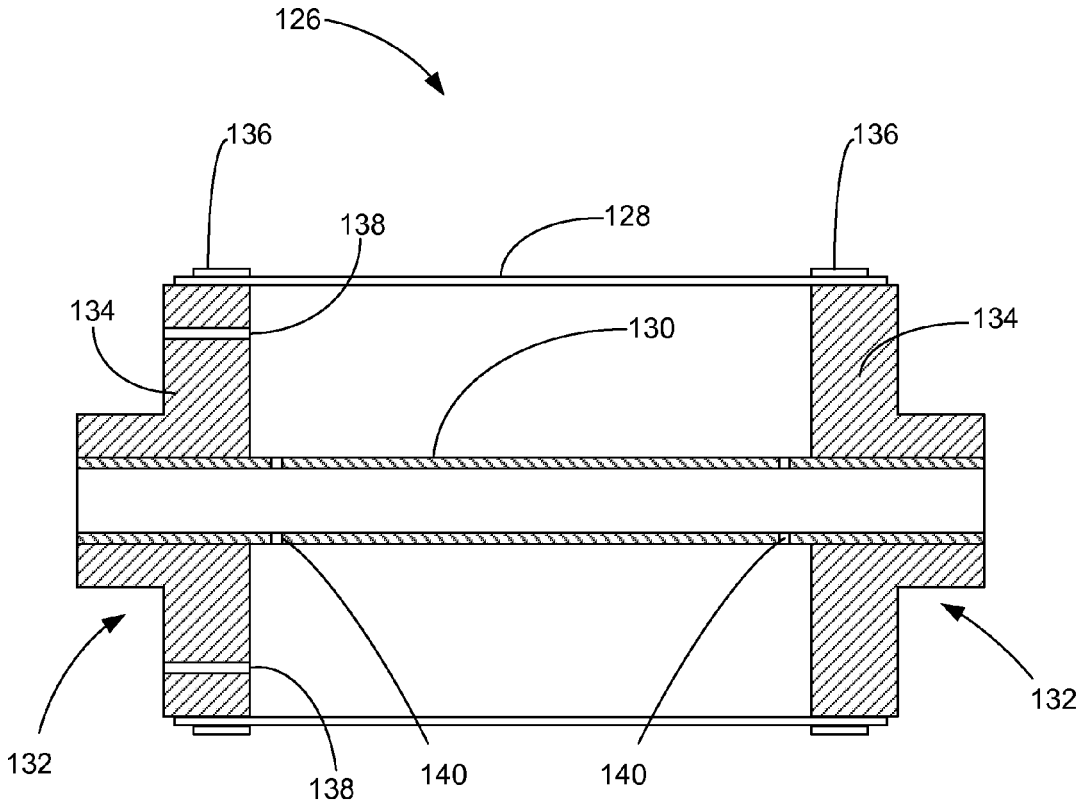
FIG. 4 is a cross-sectional perspective view of the bag section of FIG. 3.

Turning now to FIG. 4, shown therein is a cross-sectional view of a presently preferred embodiment of the seal bag assembly 126. The seal bag assembly 126 is configured to prevent the contamination of clean motor lubricants with wellbore fluids. The bag support tube 130 provides support for the seal bag 128 and shields the shaft 122 as its passes through the seal bag 128. In a preferred embodiment, the seal bag 128 is fabricated from a suitable plastic, polymer or elastomer, which are commercially available from a number of sources, including E.I. du Pont de Nemours and Company and Daikin Industries. Suitable plastics include PTFE, AFLAS® and other fluoropolymer plastics that exhibit favorable resistance to corrosive chemicals and elevated temperatures.

The seal bag retention mechanism 132 secures the seal bag 128 within the seal bag assembly 126. In a preferred embodiment, the seal bag retention mechanism 132 includes an inner flange 134 secured to the bag support tube 130 and an outer locking clamp 136. The inner flange 134 is preferably threadingly engaged or pinned with the bag support tube 130. Alternatively, the inner flange 134 can be configured to rest on a shoulder formed on the bag support tube 130.

The inner flange 134 has an outer diameter slightly larger than the inner diameter of the seal bag 128. In this way, the open end of the seal bag 128 can be pushed onto the flange 134. The elasticity of the bag material allows the seal bag 128 to stretch to conform to the shape of the flange 134. The seal bag 128 is held in place over the flange 134 by the locking clamp 136, which applies a compressive force on the end of the seal bag 128. The compressive force of the locking clamp 136 further improves the sealed engagement between the seal bag 128 and the flange 134. The locking clamp 136 is preferably provided with a worm gear mechanism configured to adjust the clamping force exerted by the locking clamp 136.

The seal bag assembly 126 is configured to permit the exchange of fluids in and out of the seal bag 128. In the preferred embodiment, at least one of the flanges 134 includes ports 138 that allow fluid to pass through the inner flange 134 from, or to, the seal bag 128. Similarly, the bag support tube 130 includes vents 140 that permit the exchange of fluid between the interior space of the bag support tube 130 and the seal bag 128.

Figure 5:
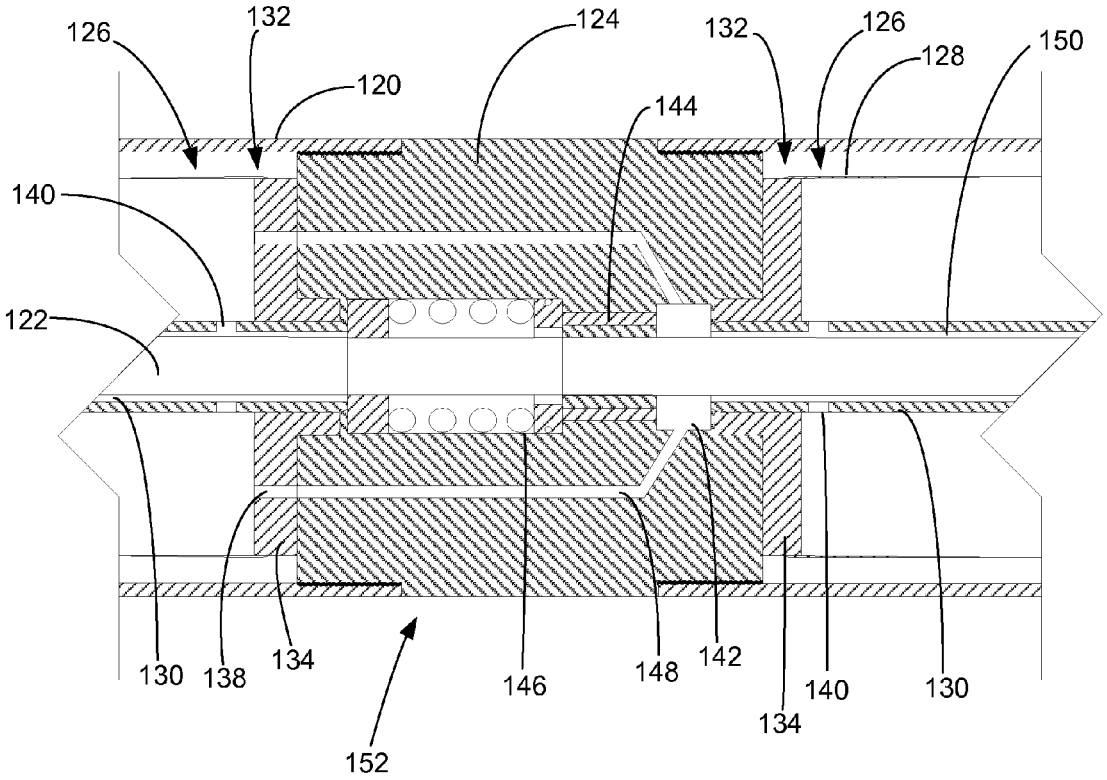
FIG. 5 is a close-up cross-sectional view of the interconnect module and bag sections from the seal section of FIG. 3.

Turning to FIG. 5, shown therein is a cross-sectional view of the interconnect module 124 and the adjacent seal bag assemblies 126. The interconnect module 124 is used to connect adjacent seal bag assemblies 126. The interconnect module 124 preferably includes an inlet plenum 142, a shaft bearing 144, a shaft seal assembly 146 and one or more fluid exchange passages 148. The interconnect module 124 is configured to accept the inner flange 134 and end of the support tube 130 of the seal bag assembly 126. In a particularly preferred embodiment, dowels or pins (not separately designated) are used to maintain positional registration between the seal bag assembly 126 and the interconnect module 124. The shaft bearing 144 is preferably configured as a hydrodynamic bearing that includes an outer stationary member fixed within the interconnect module 124 and a rotary member fixed to the shaft 122. The shaft bearing 144 aligns and stabilizes the shaft 122.

The shaft seal 146 is preferably configured as a spring-biased mechanical seal. The shaft seal 146 discourages the migration of fluid along the shaft 122. In alternate preferred embodiments, the shaft seal 146 can include a wiper seal that includes a compliant wiping mechanism in contact with the shaft 122. As depicted in FIG. 3, the shaft seals 146 are preferably oriented in alternating bellows-up and bellows-down position in adjacent interconnect modules 124. By alternating the orientation of the shaft seals 146, the resultant axial force imposed by the collection of shaft seals 146 is minimized. In a highly preferred embodiment, the number and disposition of shaft seals 146 within the seal section 112 is designed to offset or compliment the downthrust imposed on the shaft 122 by the pump assembly 108.

Continuing with FIG. 5, the bag support tube 130 includes an annular space 150 between the interior surface of the bag support tube 130 and the exterior surface of the shaft 122. The annular space 150 permits the movement of fluid between the shaft 122 and the bag support tube 130. Due to the rapid rotation of the shaft 122 within the bag support tube 130, the fluid within the annular space 150 is subject to turbulence and shear forces. If oil-based fluids encounter water-based fluids in the annular space 150, the turbulent mixing effect may cause the fluids to partially or completely emulsify. Accordingly, it is desirable to divert wellbore fluids (which may include water-based fluids) away from the turbulent region within the annular space 150.

The plenum 142 is connected to the fluid exchange passages 148 and the annular space 150 within the interior of the bag support tube 130. In this way, the plenum provides a fluid path from the adjacent seal bag 128 to the fluid exchange passages 148 extending through the interconnect module 124. Notably, the interconnect module 124 is configured to move fluid from the turbulent annular space 150 into the more stagnant region within the bag seal 128. In a preferred embodiment, the interconnect module 146 includes two or more fluid exchange passages 148 extending from the plenum 142 through the interconnect module 146 to the adjacent bag section 118. As best illustrated in FIG. 5, the fluid exchange passages 148 communicate with the ports 138 of the seal bag retention mechanism 132.

Thus, the combination of the annular space 150, plenum 142, shaft bearing 144, shaft seal 146 and fluid exchange passages 148 create a labyrinth 152 that causes fluid to pass from an upstream seal bag assembly 126 through the interconnect module 124 to the seal bag assembly 126 of a downstream bag section 118. Unlike prior art parallel bag configurations, the use of an intervening shaft seal 146 causes the fluid to be rerouted in an indirect, tortuous manner. During horizontal applications (as depicted in FIG. 1), the benefit of the labyrinth 152 is increased. Due to the tortuous nature of the indirect passages through the interconnect module 124, foreign fluids may settle out of solution in the relatively static area within the seal bag 128.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section for use in a downhole pumping system, wherein the seal section comprises:

a first seal bag assembly and a second seal bag assembly connected in a parallel arrangement, wherein each of the first and second seal bag assemblies comprises:

a bag support tube, a seal bag retention mechanism, and a seal bag that includes a non-turbulent interior space;

a shaft extending through the bag support tube of each of the first and second seal bag assemblies;

an annular space between the shaft and the bag support tube of each of the first and second seal bag assemblies, wherein the annular space comprises a turbulent region; and an interconnect module, wherein the interconnect module comprises a fluid diverter to direct fluid from the turbulent annular space of the first seal bag assembly into the non-turbulent interior space of the seal bag of the second seal bag assembly.

2. The seal section of claim 1, wherein the fluid diverter is a shaft seal assembly.

3. A seal section for use in a downhole pumping system, wherein the seal section comprises:

a first seal bag assembly, wherein the first seal bag assembly comprises:

a first seal bag support tube, and a first seal bag surrounding the first seal bag support tube, wherein an annular space between the first seal bag support tube and the first seal bag provides a first non-turbulent region, a second seal bag assembly, wherein the second seal bag assembly comprises:

a second seal bag support tube, and a second seal bag surrounding the second seal bag support tube, wherein an annular space between the second seal bag support tube and the second seal bag provides a second non-turbulent region;

a shaft extending through the first seal bag support tube and the second seal bag support tube;

a first turbulent region between the shaft and the first seal bag support tube;

a second turbulent region between the shaft and the second seal bag support tube; and an interconnect module connected between the first seal bag assembly and the second seal bag assembly, wherein the interconnect module includes a fluid diverter that is configured to direct fluid from the first turbulent region to the second non-turbulent region to place the first seal bag assembly in a parallel configuration with the second seal bag assembly.

4. The seal section of claim 3, wherein the interconnect module comprises:

an inlet plenum in fluid communication with the first turbulent region; and at least one fluid exchange passage connecting the inlet plenum and the second non-turbulent region of the second seal bag assembly.

5. The seal section of claim 4, wherein the fluid diverter comprises a shaft seal assembly that is configured to divert fluid from the first turbulent region, through the at least one fluid exchange passage and into the second non-turbulent region.

6. A seal section comprising:

a shaft;

a first seal bag assembly, wherein the first seal bag assembly comprises:

a first bag support tube that includes vents, wherein the shaft extends through an inside of the first bag support tube, a first turbulent region between the shaft and the first bag support tube, a first seal bag, a first non-turbulent region between the first bag support tube and the first seal bag, and wherein the first turbulent region is in fluid communication with the first non-turbulent region through the vents of the first bag support tube;

a second seal bag assembly, wherein the second seal bad assembly comprises:

a second bag support tube that includes vents, wherein the shaft extends through an inside of the second bag support tube, a second turbulent region between the shaft and the second bag support tube, a second seal bag, a second non-turbulent region between the second bag support tube and the second seal bag, and wherein the second turbulent region is in fluid communication with the second non-turbulent region through the vents of the second bag support tube; and an interconnect module connected between the first seal bag assembly and the second seal bag assembly, wherein the interconnect module includes a fluid diverter that places the first turbulent region in fluid communication with the second non-turbulent region.

7. The seal section of claim 6, wherein the interconnect module comprises:

an inlet plenum in fluid communication with the first turbulent region; and at least one fluid exchange passage connecting the inlet plenum and the non-turbulent interior of the second seal bag assembly.

8. The seal section of claim 7, wherein the fluid diverter comprises a shaft seal assembly that is configured to divert fluid from the first turbulent region, through the at least one fluid exchange passage and into the second non-turbulent region.

* * * * *